US009697756B2

(12) United States Patent
Roh

(10) Patent No.: US 9,697,756 B2
(45) Date of Patent: Jul. 4, 2017

(54) TIMING CONTROLLER INCLUDING CONFIGURABLE CLOCK SIGNAL GENERATORS ACCORDING TO DISPLAY MODE AND DISPLAY DEVICE HAVING THE SAME

(71) Applicant: SAMSUNG DISPLAY CO., LTD., Yongin, Gyeonggi-Do (KR)

(72) Inventor: Seok-Hwan Roh, Cheonan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 115 days.

(21) Appl. No.: 14/607,205

(22) Filed: Jan. 28, 2015

(65) Prior Publication Data

US 2016/0063945 A1 Mar. 3, 2016

(30) Foreign Application Priority Data

Aug. 27, 2014 (KR) ..... 10-2014-0112076

(51) Int. Cl.

| | |
|---|---|
| ***G09G 5/00*** | (2006.01) |
| ***G09G 3/00*** | (2006.01) |
| ***G09G 5/04*** | (2006.01) |

(52) U.S. Cl.

CPC ..... *G09G 3/003* (2013.01); *G09G 5/008* (2013.01); *G09G 5/04* (2013.01); *G09G 2310/08* (2013.01); *G09G 2340/0435* (2013.01)

(58) Field of Classification Search

CPC ..... G09G 3/003; G09G 5/04; G09G 5/008; G09G 2310/08; G09G 2340/0435

See application file for complete search history.

(56) References Cited

U.S. PATENT DOCUMENTS 6,046,737 A * 4/2000 Nakamura ..... G09G 3/2092 345/213
7,362,797 B2 * 4/2008 Chan ..... H04L 12/26 375/219

(Continued)

FOREIGN PATENT DOCUMENTS

KR 1020080034303 4/2008
KR 1020100130086 12/2010

(Continued)

*Primary Examiner* — Kwang-Su Yang
(74) *Attorney, Agent, or Firm* — F. Chau & Associates, LLC

(57) ABSTRACT

A timing controller includes a display mode detection circuit configured to detect an image display mode of a display panel based on a plurality of first image data signals that are output in synchronization with a first clock signal having a first frequency, and to selectively activate at least one clock signal generation selected among a plurality of clock signal generators based on the detected image display mode, the clock signal generators configured to generate a second clock signal having a second frequency, respectively when activated by the display mode detection circuit, and to apply the second clock signal to a plurality of signal converting circuits, respectively, and the signal converting circuits configured to convert the first image data signals into a plurality of second image data signals that are output in synchronization with the second clock signal.

20 Claims, 6 Drawing Sheets

(56) References Cited

U.S. PATENT DOCUMENTS

| | | | | |
|---|---|---|---|---|
| 8,213,490 | B2 * | 7/2012 | Jang | H04L 25/03885 375/224 |
| 8,587,643 | B2 * | 11/2013 | Kim | G02B 27/2264 348/51 |
| 2003/0185332 | A1 * | 10/2003 | Cheng | G09G 5/008 375/376 |
| 2010/0302214 | A1 | 12/2010 | Kim et al. | |
| 2011/0248966 | A1 | 10/2011 | Ahn et al. | |

FOREIGN PATENT DOCUMENTS

| | | |
|---|---|---|
| KR | 1020100135643 | 12/2010 |
| KR | 1020110114130 | 10/2011 |

* cited by examiner

TIMING CONTROLLER INCLUDING CONFIGURABLE CLOCK SIGNAL GENERATORS ACCORDING TO DISPLAY MODE AND DISPLAY DEVICE HAVING THE SAME

CROSS REFERENCE TO RELATED APPLICATION

This application claims priority to Korean Patent Application No. 10-2014-0112076, filed on Aug. 27, 2014 in the Korean Intellectual Property Office (KIPO), the disclosure of which is incorporated by reference in its entirety herein.

BACKGROUND

1. Technical Field

Exemplary embodiments of the inventive concept relate to electronic devices. More particularly, exemplary embodiments of the inventive concept relate to a timing controller and display devices having the same.

2. Discussion of Related Art

A display device can operate in various image display modes. For example, the display device can operate in a two-dimensional (2D) image display mode to display 2D images or a stereoscopic (three-dimensional (3D)) image display mode to display 3D images. The display device may process a different amount of data based on the type of the display mode. In a multi-view mode, multiple users are capable of viewing different content simultaneously.

However, in the multi-view mode, power consumption of the display device may be high and heat generated by a timing controller of the display device that performs image processing may damage the display device.

SUMMARY

At least one embodiment of the inventive concept provides a timing controller, which may reduce power consumption in an image data process.

At least one embodiment of the inventive concept provides a display device having the timing controller.

According to an exemplary embodiment of the inventive concept, a timing controller includes a display mode detection circuit, a plurality of clock signal generators, and a plurality of signal converting circuits. The display mode detection circuit is configured to detect an image display mode of a display panel based on a plurality of first image data signals that are output in synchronization with a first clock signal having a first frequency, and to selectively activate at least one clock signal generator selected among a plurality of clock signal generators based on the image display mode. Each clock signal generator, when activated by the display mode detection circuit, is configured to generate a second clock signal having a second frequency and to apply the second clock signal to a distinct one of the plurality of signal converting circuits. The signal converting circuits are configured to convert the first image data signals to a plurality of second image data signals that are output in synchronization with the second clock signal.

In an exemplary embodiment, power consumption of the signal converting circuits to which the second clock signal is not applied, may decrease. The display mode detection circuit may be configured to deactivate at least one of the clock signal generators based on the detected display mode to reduce power consumption of the signal converting circuits.

In an exemplary embodiment, each of the clock signal generators may include a phase locked loop (PLL).

In an exemplary embodiment, each of the signal converting units may include a plurality of gigabit transceivers.

In an exemplary embodiment, the first image data signals may be transferred through a plurality of channels, and a whole number of the gigabit transceivers may be the same as a whole number of the channels.

In an exemplary embodiment, the image display mode may include a multi-view mode in which the display panel alternately displays a plurality of contents. The number of the contents that are displayed on the display panel may be the same as the number of activated clock signal generators.

In an exemplary embodiment, the first frequency may be N times the second frequency, where N is an integer greater than or equal to 1.

In an exemplary embodiment, the number of bits of the second image data signals transferred per clock cycle may be N times the number of bits of the first image data signals transferred per clock cycle.

In an exemplary embodiment, the timing controller may further comprise an image processor configured to perform an image processing on the second image data signals.

According to an exemplary embodiment of the inventive concept, a display device includes a display panel, a display panel driver configured to provide a scan signal and a data signal to the display panel, a plurality of frame rate controllers, and a timing controller configured to control the display panel driver. The plurality of frame rate controllers are configured to generate a plurality of first image data signals that are output in synchronization with a first clock signal having a first frequency by changing a frame rate of an input image data. The timing controller includes a display mode detection circuit, a plurality of clock signal generators, and a plurality of signal converting circuits. The display mode detection circuit is configured to detect an image display mode of the display panel based on the first image data signals, and to selectively activate at least one clock signal generator selected among a plurality of the clock signal generators based on the image display mode. Each clock signal generator, when activated by the display mode detection circuit, is configured to generate a second clock signal having a second frequency and to apply the second clock signal to a distinct one of the plurality of signal converting circuits. The signal converting units are configured to convert the first image data signals into a plurality of second image data signals that are output in synchronization with the second clock signal.

In an exemplary embodiment, the display panel includes a plurality of display areas, and the timing controller includes a plurality of sub-timing controllers.

In an exemplary embodiment, each of the sub-timing controllers may control the scan signal and the data signal that are applied to an assigned display area of the display areas.

In an exemplary embodiment, power consumption of the signal converting circuits to which the second clock signal is not applied, may decrease.

In an exemplary embodiment, each of the clock signal generators may include a phase locked loop (PLL).

In an exemplary embodiment, each of the signal converting units may include a plurality of gigabit transceivers.

In an exemplary embodiment, the first image data signals may be transferred through a plurality of channels, and a whole number of the gigabit transceivers may be the same as a whole number of the channels.

In an exemplary embodiment, the image display mode may include a multi-view mode in which the display panel alternately displays a plurality of contents, and the number of contents that are displayed on the display panel may be the same as the number of activated clock signal generators.

In an exemplary embodiment, the first frequency may be N times the second frequency, where N is an integer greater than or equal to 1.

In an exemplary embodiment, the number of bits of the second image data signals transferred per clock cycle may be N times the number of bits of the first image data signals transferred per clock cycle.

In an exemplary embodiment, the timing controller may further include an image processor configured to perform an image processing on the second image data signals.

According to an exemplary embodiment of the inventive concept, a timing controller includes a plurality clock signal generator and signal conversion circuit pairs, wherein each signal conversion circuit performs a conversion on received image data signals for output to a display device only when its corresponding clock signal generator is activated, and a circuit configured to determine a number of distinct display areas of the display device needed based on an analysis of the image data signals, and activate only the detected number of clock signal generators. In an exemplary embodiment, the circuit outputs the image data signals to the signal conversion circuits in synchronization with a first clock signal and only the activated clock signal generators generate a second clock signal for application to a corresponding signal conversion circuit.

A timing controller according to at least one embodiment of the inventive concept may selectively activate the clock signal generators based on the display image mode so that power consumption in an image data processing may decrease. Thus, heat from the timing controller may decrease. As a result, the display device may prevent heat damage caused by operating the timing controller.

BRIEF DESCRIPTION OF THE DRAWINGS

Exemplary embodiments of the inventive concept can be understood in more detail from the following description taken in conjunction with the accompanying drawings, in which.

DETAILED DESCRIPTION

The inventive concept will be described more fully hereinafter with reference to the accompanying drawings, in which various embodiments are shown.

Figure 1:
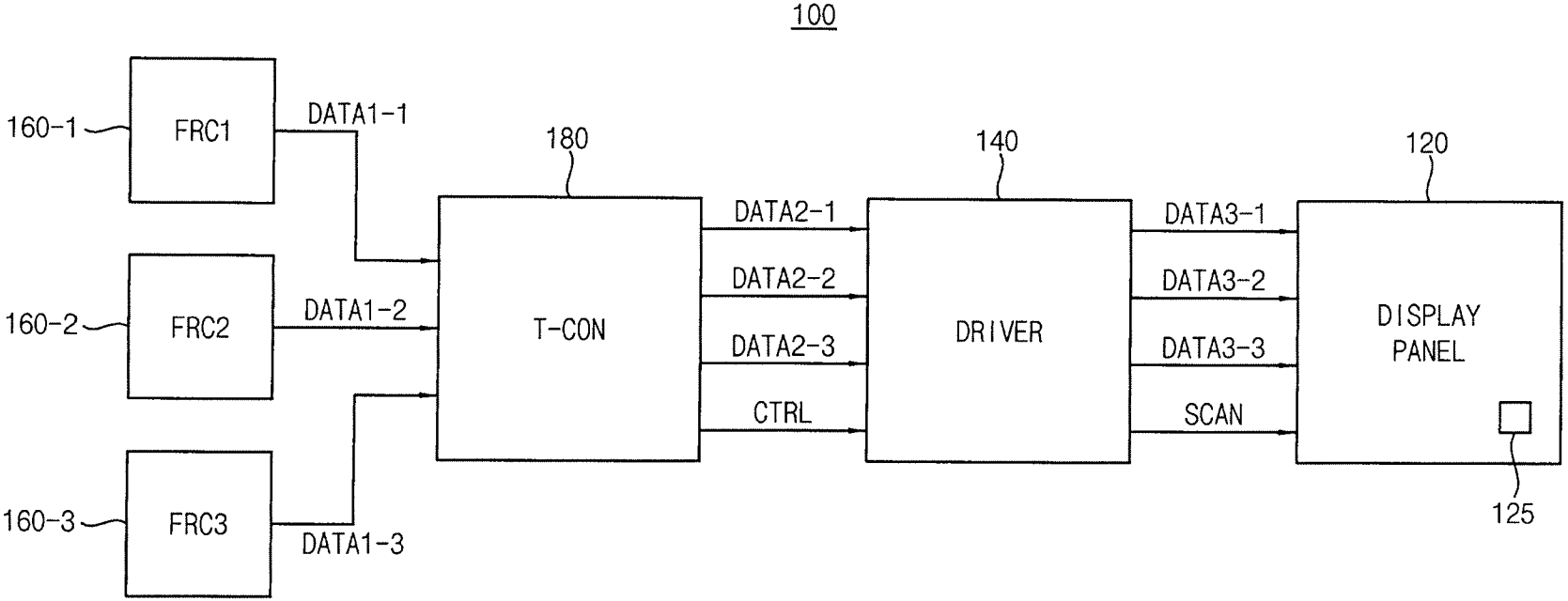
FIG. 1 is a block diagram of a display device according to an exemplary embodiment of the inventive concept.

FIG. 1 is a block diagram of a display device according to an exemplary embodiment of the inventive concept.

Referring to FIG. 1, the display panel 100 includes a display panel 120, a display panel driver 140, a plurality of frame rate controllers 160-1, 160-2 and 160-3, and a timing controller 180.

The display panel 120 may include a plurality of pixels 125. The pixels 125 may emit light based on data signals DATA3-1, DATA3-2 and DATA3-3 applied within an active period of a scan signal SCAN. For example, the scan signal SCAN has an active period and an inactive period. For example, the scan signal SCAN may have a first logic state during the active period and a second other logic state during the inactive period. Each pixel 125 may include sub-pixels. For example, the sub-pixels may emit light corresponding to three primary colors of light. The sub-pixels may emit light having a certain luminance based on the data signals DATA3-1, DATA3-2 and DATA3-3. Each pixel 125 may display a target gray level and a target luminance by a combination of lights emitted from the sub-pixels.

The display panel driver 140 applies the scan signal SCAN and the data signals DATA3-1, DATA3-2 and DATA3-3 to the display panel 120. The display panel driver 140 receives second image data signals DATA2-1, DATA2-2 and DATA2-3 and a control signal CTRL, and applies the scan signal SCAN and the data signals DATA3-1, DATA3-2 and DATA3-3 to the display panel 120 based on the control signal CTRL. The display panel driver 140 may include a scan driver and a data driver. The scan driver may generate the scan signal SCAN based on the control signal CTRL, and the data driver may generate the data signals DATA3-1, DATA3-2 and DATA3-3 based on the control signal CTRL. In general, the scan signal SCAN may be applied to a target pixel to apply the data signals DATA3-1, DATA3-2 and DATA3-3 to the target pixel at exactly the right time. The scan signal SCAN applied to the target pixel is activated such that the data signals DATA3-1, DATA3-2 and DATA3-3 are applied to the target pixel. That is, the data signals DATA3-1, DATA3-2 and DATA3-3 may be applied to the pixel 125 at exactly the right time by adjusting a timing in which the scan signal SCAN is activated.

The plurality of frame rate controllers (FRCs) 160-1, 160-2 and 160-3 generate a plurality of first image data signals DATA1-1, DATA1-2 and DATA1-3 by changing a frame rate of an input image data from external image sources. The frame rate may be the rate at which an imaging device produces unique consecutive images called frames. Here, the first image data signals DATA1-1, DATA1-2 and DATA1-3 may be output in synchronization with a first clock signal having a first frequency.

Each of the frame rate controllers 160-1, 160-2 and 160-3 changes the frame rate of the input image data referring to an output rate of the display panel 120 such that the display panel 120 displays a plurality of contents. For example, when the output rate of the display panel 120 is 60 Hz, each of the frame rate controllers 160-1, 160-2 and 160-3 changes the frame rate of each image data to (n×60)Hz, and generates the first image data signals DATA1-1, DATA1-2 and DATA1-3 based on the changed frame rate. For example, when the display panel 120 alternately displays 2 contents each operating in 120 Hz, each of the frame rate controllers 160-1, 160-2 and 160-3 changes the frame rate of each image data to 240 Hz (i.e., 2×120 Hz=240 Hz), and generates the first image data signals DATA1-1, DATA1-2 and DATA1-3 based on the changed frame rate (i.e., 240 Hz).

When the frame rates of the input image data are different, each of the frame rate controllers 160-1, 160-2 and 160-3 changes the respective frame rates of the input image data to have the same frame rate. In an exemplary embodiment, at least one of the frame rate controllers 160-1, 160-2 and 160-3 inserts additional frames into the input image data having a relatively low frame rate until all the changed frame rates of the input image data by the frame rate controllers 160-1, 160-2 and 160-3 are substantially the same. In an exemplary embodiment, at least one of the frame rate controllers 160-1, 160-2 and 160-3 deletes unnecessary frames of the input image data having relatively high frame rate until all the changed frame rates of the input image data by the frame rate controllers 160-1, 160-2 and 160-3 are substantially the same.

The timing controller 180 may control the display panel driver 140. In an exemplary embodiment, the timing controller 180 controls application of the scan signal SCAN and the data signal DATA3-1, DATA3-2 and DATA3-3 based on the control signal CTRL.

The timing controller 180 may include a display mode detection unit, a plurality of clock signal generators, and a plurality of signal converting units. The display mode detection unit may detect an image display mode based on the first image data signals DATA1-1, DATA1-2 and DATA1-3. In an exemplary embodiment, the signal converting units are circuits, such as a serializer/deserializer (SerDes), which convert data between serial data and parallel interfaces. In an exemplary embodiment, the signal converting units are circuits such as gigabit or multi-gigabit transceivers. Further, the display mode detection unit may selectively activate at least one clock signal generator selected among the plurality of clock signal generators based on the image display mode. The clock signal generators may respectively generate a second clock signal having a second frequency when the clock signal generators are activated by the display mode detection unit. The activated clock signal generators may respectively apply the second clock signal to the plurality of signal converting units that respectively correspond to the activated clock signal generators.

In an exemplary embodiment, each of the clock signal generators includes a phase locked loop (PLL). The signal converting units may convert the first image data signals (e.g., DATA-1, DATA1-2, and DATA1-3) to a plurality of second image data signals (e.g., DATA2-1, DATA2-2, and DATA2-3). Here, the second image data signals may be output in synchronization with the second clock signal. In an exemplary embodiment, each of the signal converting units includes a plurality of gigabit transceivers. In an exemplary embodiment, a gigabit transceiver is a SerDes capable of operating at serial bit rates above 1 Gigabit/second. In an exemplary embodiment, the gigabit transceiver is used transmit parallel data as a stream of serial bits, and convert the serial bits its receives to parallel data. Power consumption of the signal converting units to which the second clock signal is not applied may decrease. Exemplary embodiments of elements of the timing controller 180 will be described in detail with reference to FIGS. 4 and 5.

As described above, the timing controller 180 selectively activates the clock signal generators based on the display image mode so that power consumption in an image data processing may decrease. Thus, heat generated by the timing controller may decrease. As a result, the display device 100 may prevent heat damage caused by operating the timing controller.

Figure 2:
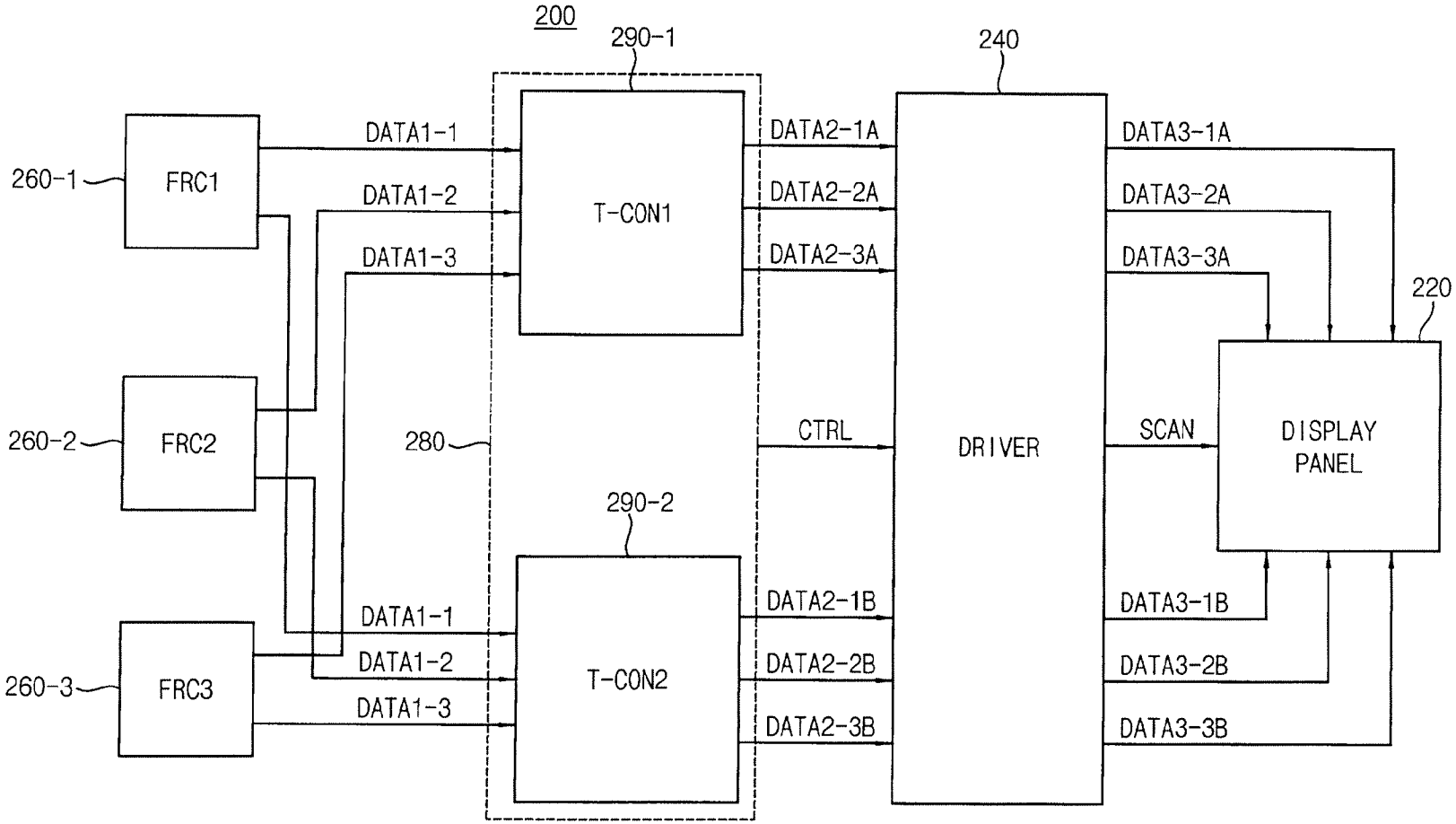
FIG. 2 is a block diagram illustrating an exemplary embodiment of the display device of FIG. 1 including a plurality of sub-timing controllers.

FIG. 2 is a block diagram illustrating an embodiment of the display device of FIG. 1 including a plurality of sub-timing controllers.

Referring to FIG. 2, the display device 200 includes a display panel 220, a display panel driver 240, a plurality of frame rate controllers 260-1, 260-2 and 260-3, and a timing controller 280. The timing controller 280 includes a plurality of sub-timing controllers 290-1 and 290-2.

The display panel 220 may include a plurality of pixels. The pixels may emit light based on data signals DATA3-1A, DATA3-2A, DATA3-3A, DATA3-1B, DATA3-2B and DATA3-3B applied within an active period of a scan signal SCAN. Each pixel may include sub-pixels. As a result, each pixel may display a target gray level and a target luminance by a combination of lights emitted from the sub-pixels.

The display panel driver 240 applies the scan signal SCAN and the data signals DATA3-1A, DATA3-2A, DATA3-3A, DATA3-1B, DATA3-2B and DATA3-3B to the display panel 220. The display panel driver 240 receives second image data signals DATA2-1A, DATA2-2A, DATA2-3A, DATA2-1B, DATA2-2B and DATA2-3B and a control signal CTRL, and applies the scan signal SCAN and the data signals DATA3-1A, DATA3-2A, DATA3-3A, DATA3-1B, DATA3-2B and DATA3-3B to the display panel 220 based on the control signal CTRL. The display panel driver 240 may include a scan driver and a data driver.

The plurality of frame rate controllers 260-1, 260-2 and 260-3 generate a plurality of first image data signals DATA1-1, DATA1-2 and DATA1-3 by changing a frame rate of an input image data from external image sources. Here, the first image data signals DATA1-1, DATA1-2 and DATA1-3 may be output in synchronization with a first clock signal having a first frequency.

Each of the frame rate controllers 260-1, 260-2 and 260-3 changes the frame rate of the input image data referring to an output rate of the display panel 220 such that the display panel 220 displays a plurality of contents. In an exemplary embodiment, when the output rate of the display panel 220 is 60 Hz, each of the frame rate controllers 260-1, 260-2 and 260-3 changes the frame rate of each image data to (n×60) Hz, and generates the first image data signals DATA1-1, DATA1-2 and DATA1-3 based on the changed frame rate.

When the frame rates of the input image data are different, each of the frame rate controllers 260-1, 260-2 and 260-3 changes the respective frame rates of the input image data to have the same frame rate.

According to an exemplary embodiment of the inventive concept, the display panel 220 is divided into a plurality of display areas. In an exemplary embodiment, the display panel 220 is divided into two display areas based on a virtual vertical dividing line such that the display panel has a left-side display area and a right-side display area that have substantially the same size. In an exemplary embodiment, the display panel 220 is divided into two display areas based on a virtual horizontal dividing line such that the display panel has an upper-side display area and a lower-side display area that have substantially the same size. In an exemplary embodiment, the display panel 220 is divided into three display areas based on two virtual vertical dividing lines. However, the dividing of the display panel 220 is not limited thereto. For example, the display panel 220 may be divided into any number of display areas with various shapes and sizes.

In an exemplary embodiment, the timing controller 280 includes the plurality of sub-timing controllers 290-1 and 290-2. In an exemplary embodiment, one of the sub-timing controllers 290-1 and 290-2 is a master sub-timing controller and the other is a slave sub-timing controller. While FIG. 2 shows two sub-timing controllers, in an embodiment, additional sub-timing controllers are present, and thus there may be multiple slave sub-timing controllers.

The frame rate controllers 260-1, 260-2 and 260-3 apply the respective first image data signals DATA1-1, DATA1-2 and DATA1-3 to the sub-timing controllers 290-1 and 290-2. For example, a first frame rate controller 260-1 applies the first image data signal DATA1-1 to a first sub-timing controller 290-1 and a second sub-timing controller 290-2, a second frame rate controller 260-2 applies the first image data signal DATA1-2 to the first sub-timing controller 290-1 and the second sub-timing controller 290-2, and a third frame rate controller 260-3 applies the first image data signal DATA1-3 to the first sub-timing controller 290-1 and the second sub-timing controller 290-2.

According to an exemplary embodiment of the inventive concept, the first sub-timing controller 290-1 controls the scan signal SCAN and the data signals DATA3-1A, DATA3-2A, DATA3-3A, DATA3-1B, DATA3-2B and DATA3-3B applied to a first display area of the display panel 220, and the second sub-timing controller 290-2 controls the scan signal SCAN and the data signals DATA3-1A, DATA3-2A, DATA3-3A, DATA3-1B, DATA3-2B and DATA3-3B applied to a second display area of the display panel 220. In an exemplary embodiment, the first and second display areas respectively correspond to the left-side display area and the right-side display area of the display panel 220. In an exemplary embodiment, the first and second display areas respectively correspond to the upper-side display area and the lower-side display area of the display panel 220. However, methods of controlling the scan signal SCAN and the data signals DATA3-1A, DATA3-2A, DATA3-3A, DATA3-1B, DATA3-2B and DATA3-3B by the sub-timing controllers 290-1 and 290-2 are not limited thereto. The number of sub-timing controllers is not limited to the amount illustrated in FIG. 2.

Each of the sub-timing controllers 290-1 and 290-2 may include a display mode detection unit, a plurality of clock signal generators, and a plurality of signal converting units. In an exemplary embodiment, each of the clock signal generators includes a phase locked loop (PLL). Power consumption of the signal converting units to which the second clock signal is not applied may decrease.

As described above, the sub-timing controllers 290-1 and 290-2 selectively activate the clock signal generators based on the display image mode so that power consumption in an image data processing may decrease. Thus, heat generated by the sub-timing controllers 290-1 and 290-2 may decrease. As a result, the display device 200 may prevent heat damage caused by operating the timing controller.

Figure 3:
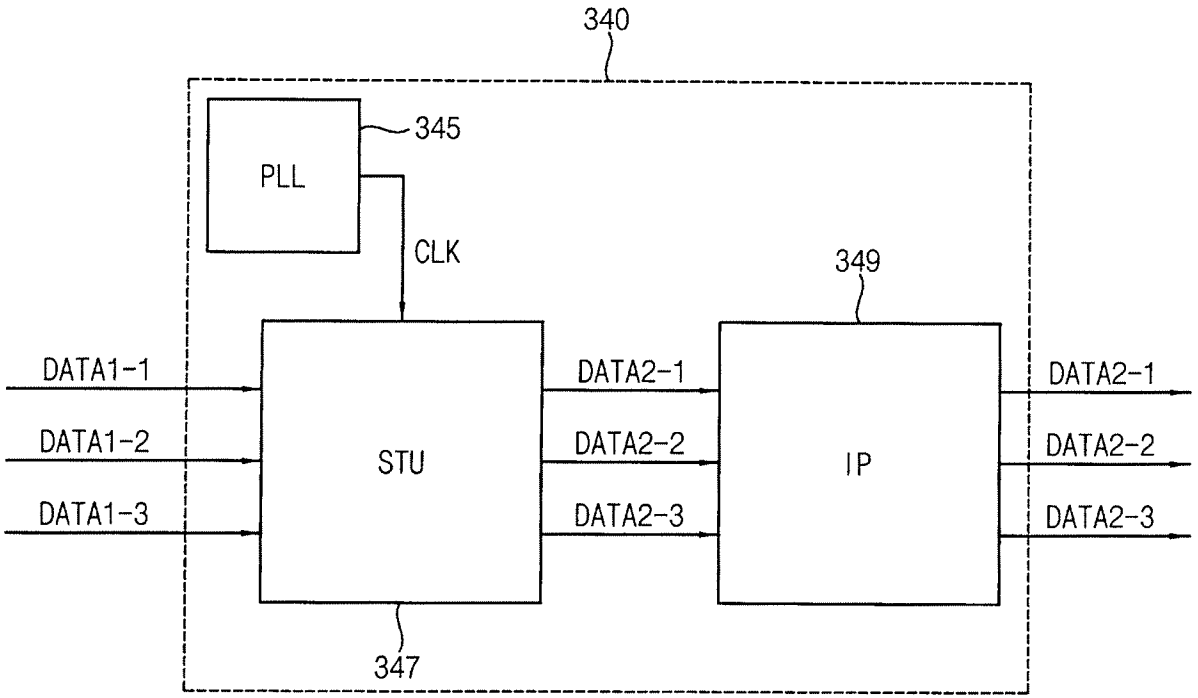
FIG. 3 is a block diagram illustrating an exemplary embodiment of a timing controller included in the display device of FIG. 1.

FIG. 3 is a block diagram illustrating an exemplary embodiment of a timing controller included in the display device of FIG. 1.

Referring to FIG. 3, the timing controller 340 includes a clock signal generator 345 and a signal converting unit 347. In exemplary embodiment, the timing controller 340 further includes an image processor 349.

The clock signal generator 345 may generate a second clock signal CLK. The second clock signal CLK may have a second frequency. In an exemplary embodiment, the clock signal generator 345 includes a phase locked loop (PLL).

The signal converting unit 347 converts first image data signals DATA1-1, DATA1-2 and DATA1-3 into second image data signals DATA2-1, DATA2-2 and DATA2-3. The first image data signals DATA1-1, DATA1-2 and DATA1-3 may be applied to the signal converting unit 347 in synchronization with a first clock signal. The second image data signals DATA2-1, DATA2-2 and DATA2-3 may be output from the signal converting unit 347 in synchronization with the second clock signal. The first clock signal may have a first frequency.

In an exemplary embodiment, the first frequency is N times the second frequency, where N is a positive integer greater than or equal to 1. In addition, the number of bits of the second image data signals DATA2-1, DATA2-2 and DATA2-3 transferred per clock cycle may be N times the number of bits of the first image data signals DATA1-1, DATA1-2 and DATA1-3 transferred within the one clock cycle. Thus, the first image data signals DATA1-1, DATA1-2 and DATA1-3 may be converted into the second image data signals DATA2-1, DATA2-2 and DATA2-3 without data loss.

In an exemplary embodiment, the signal converting unit 347 includes a plurality of gigabit transceivers. The first image data signals DATA1-1, DATA1-2 and DATA1-3 may be transferred through a plurality of channels and the whole number of the gigabit transceivers may be the same as the whole number of the channels. For example, as illustrated in FIG. 3, whole number of the gigabit transceivers is 24 when three of the first image data signals DATA1-1, DATA1-2 and DATA1-3 are respectively transferred through 8 channels.

In an exemplary embodiment, the image processor 349 performs an image processing on the second image data signals DATA2-1, DATA2-2 and DATA2-3. For example, the image processor 349 may perform a gamma correction operation on the second image data signals DATA2-1, DATA2-2 and DATA2-3 such that a voltage drop of a data signal applied to a pixel can be compensated.

Figure 4:
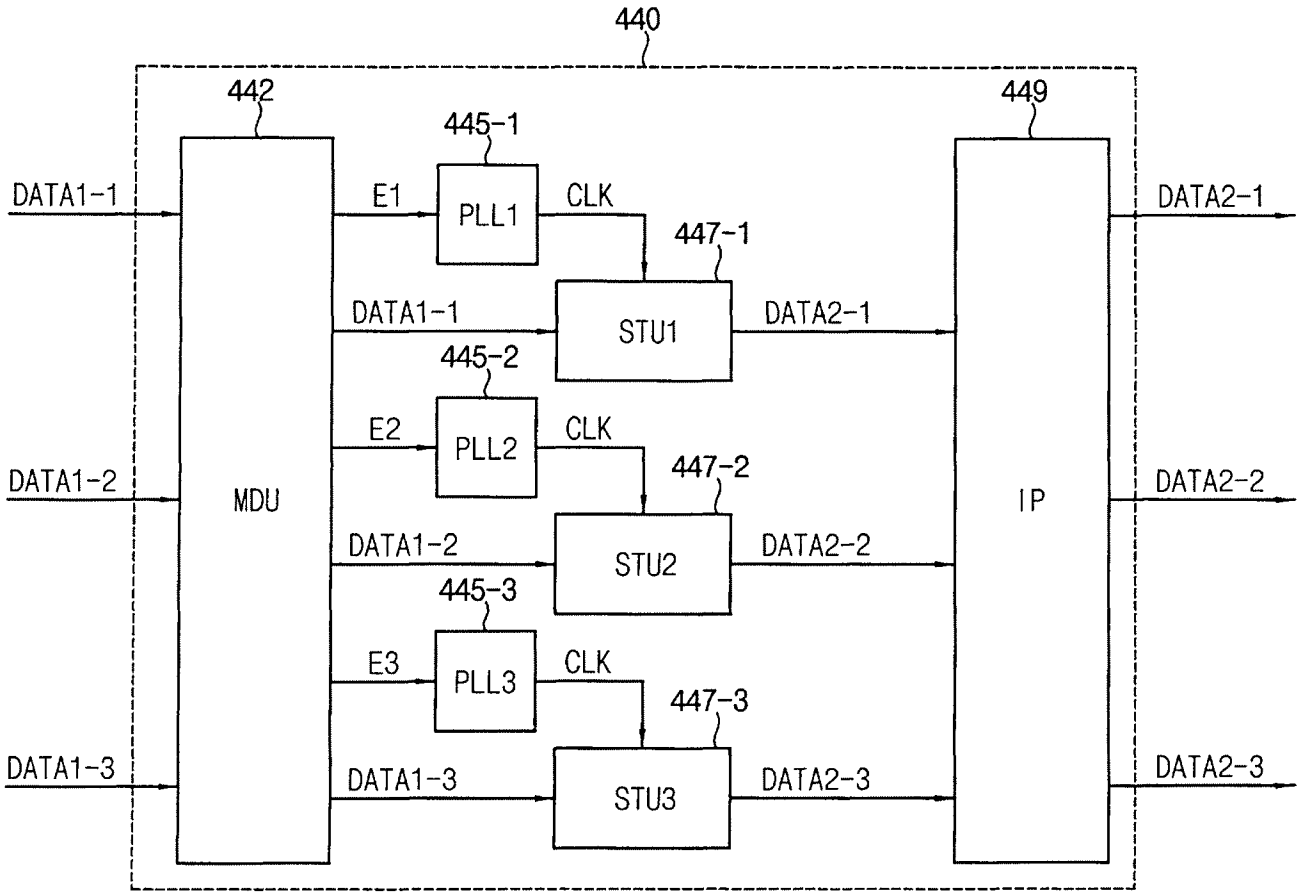
FIG. 4 is a block diagram of a timing controller according to an exemplary embodiment of the inventive concept.

FIG. 4 is a block diagram of a timing controller according to an exemplary embodiment of the inventive concept.

Referring to FIG. 4, the timing controller 440 includes a display mode detection unit 442, a plurality of clock signal generators 445-1, 445-2 and 445-3, and a plurality of signal converting units 447-1, 447-2 and 447-3. In an exemplary embodiment, the timing controller 440 further includes an image processor 449.

The display mode detection unit 442 detects an image display mode of a display panel based on a plurality of first image data signals DATA1-1, DATA1-2 and DATA1-3. For example, the display mode detection unit 442 may detect a stereoscopic image display mode (i.e., three-dimensional (3D) image display mode) that the display panel displays a stereoscopic image based on the first image data signals DATA1-1, DATA1-2 and DATA1-3. In an exemplary embodiment, the image display mode has a multi-view mode in which the display panel alternately displays a plurality of contents. In the multi-view mode, the display panel alternately displays the contents (i.e., image contents) having increased frame rate by a frame rate controller. In this case, users may watch one content selected from among the plurality of contents using a selection apparatus such as glasses, polarizing filter glasses, etc., so that a plurality of users may respectively watch a plurality of image contents through the one display panel at the same time. In this case, the display mode detection unit 442 may detect the number of contents and kinds of displayed images (e.g., two-dimensional (2D) image, 3D image, etc.) based on the first image data signals DATA1-1, DATA1-2 and DATA1-3. For example, the display mode detection unit 442 may detect the multi-view mode that the display panel alternately displays one 2D image (i.e., a 2D content) and two 3D images (i.e., 2 3D contents).

The display mode detection unit 442 may selectively activate at least one clock signal generator selected from among the clock signal generators 445-1, 445-2 and 445-3 based on the detected image display mode. In an exemplary embodiment, the display mode detection unit 442 generates activation signals E1, E2 and E3 to activate the clock signal generators 445-1, 445-2 and 445-3, respectively. The display mode detection unit 442 may selectively generate activation signals E1, E2 and E3 respectively corresponding to the clock signal generators 445-1, 445-2 and 445-3 to selectively activate the clock signal generators 445-1, 445-2 and 445-3. For example, the number of activated clock signal generators when the display panel displays the 2D image is less than the number of activated clock signal generators when the display panel displays the 3D image. In an exemplary embodiment, the number of contents that are displayed on the display panel is same as the number of the activated clock signal generators. For example, the display mode detection unit 442 may activate two of the clock signal generators when two of the contents are alternately displayed on the display panel.

The clock signal generators 445-1, 445-2 and 445-3 generate a second clock signal CLK having a second frequency when the clock signal generators 445-1, 445-2 and 445-3 are activated by the display mode detection unit 442. Each of the clock signal generators 445-1, 445-2 and 445-3 applies the second clock signal to the signal converting units 447-1, 447-2 and 447-3 that respectively correspond to the clock signal generators 445-1, 445-2 and 445-3. In an exemplary embodiment, each of the clock signal generators 445-1, 445-2 and 445-3 includes a phase locked loop (PLL).

The signal converting units 447-1, 447-2 and 447-3 may convert the first image data signals DATA1-1, DATA1-2 and DATA1-3 into the second image data signals DATA2-1, DATA2-2 and DATA2-3. The first image data signals DATA1-1, DATA1-2 and DATA1-3 may be respectively applied to the signal converting units 447-1, 447-2 and 447-3 in synchronization with a first clock signal. The second image data signals DATA2-1, DATA2-2 and DATA2-3 may be respectively output from the signal converting units 447-1, 447-2 and 447-3 in synchronization with the second clock signal. The first clock signal may have a first frequency. In an exemplary embodiment, the signal converting units in which the second clock signal is not applied among the signal converting units 447-1, 447-2 and 447-3 does not generate the second data signals (i.e., does not operate). For example, a signal converting unit does not generate a data signal unless it receives a clock signal from its respective clock signal generator, and the respective clock signal generator does not send the clock signal unless it is activated. Thus, power consumption of the signal converting units to which the second clock signal is not applied may decrease. For example, if the second clock signal CLK is not applied to the first signal converting unit 447-1, the first signal converting unit 447-1 cannot generate the second image data signal DATA2-1. Thus, power consumption of the first signal converting unit 447-1 may be reduced.

In an exemplary embodiment, the first frequency is N times the second frequency, where N is a positive integer greater than or equal to 1. In an exemplary embodiment, N is greater than 1. In addition, the number of bits of the second image data signals DATA2-1, DATA2-2 and DATA2-3 transferred per clock cycle may be N times the number of bits of the first image data signals DATA1-1, DATA1-2 and DATA1-3 transferred within the one clock cycle. Thus, the first image data signals DATA1-1, DATA1-2 and DATA1-3 may be converted into the second image data signals DATA2-1, DATA2-2 and DATA2-3 without data loss.

In an exemplary embodiment, each of the signal converting units 447-1, 447-2 and 447-3 includes a plurality of gigabit transceivers. The first image data signals DATA1-1, DATA1-2 and DATA1-3 may be transferred through a plurality of channels. The whole number of the gigabit transceivers may be the same as the whole number of the channels. For example, as illustrated in FIG. 4, whole number of the gigabit transceivers is 24 when three of the first image data signals DATA1-1, DATA1-2 and DATA1-3 are respectively transferred through 8 channels.

In an exemplary embodiment, the image processor 449 performs an image processing on the second image data signals DATA2-1, DATA2-2 and DATA2-3. For example, the image processor 449 may perform a gamma correction operation on the second image data signals DATA2-1, DATA2-2 and DATA2-3 such that a voltage drop of a data signal applied to a pixel can be compensated.

Figure 5:
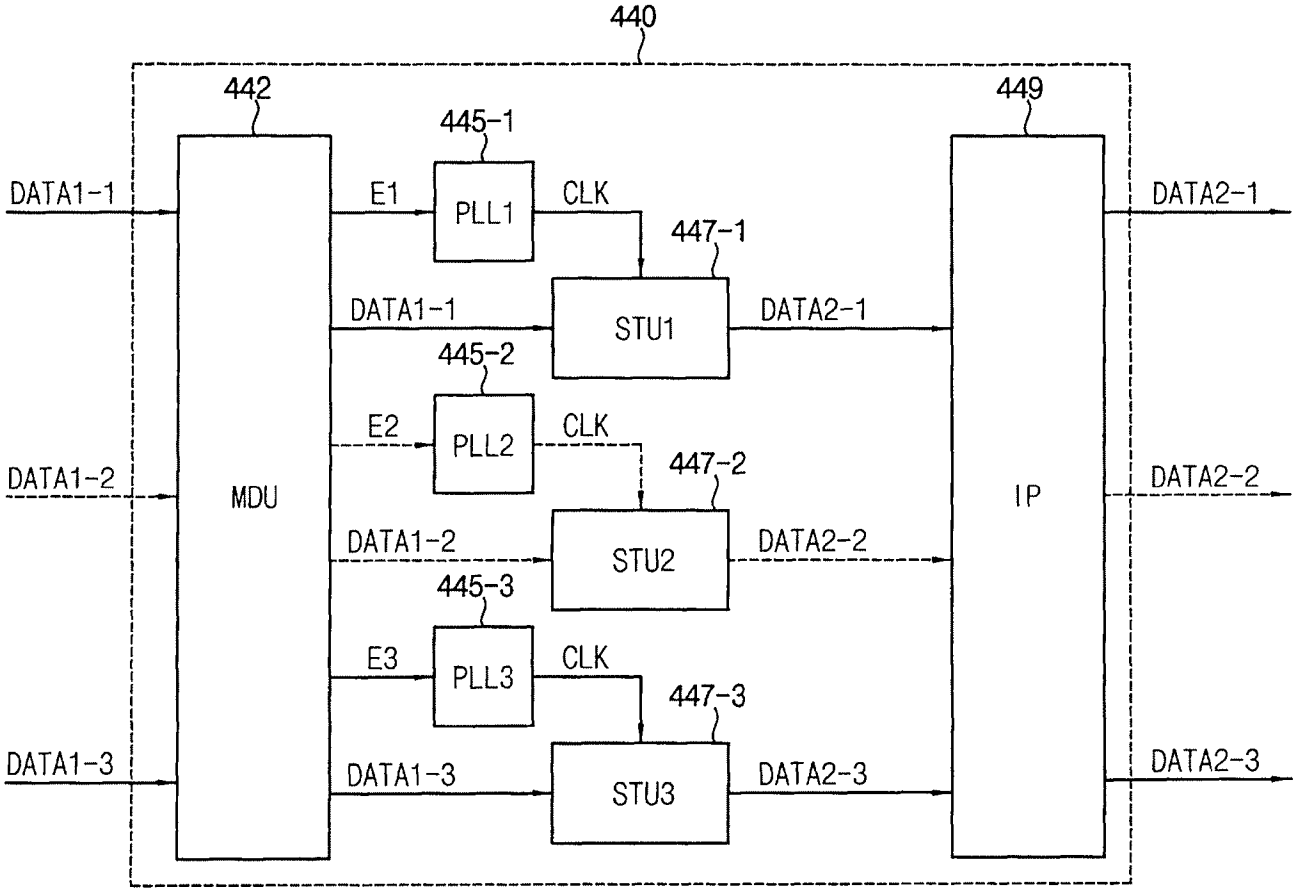
FIG. 5 is a block diagram illustrating an exemplary embodiment of the timing controller of FIG. 4 that is capable of deactivating at least one clock signal generator.

FIG. 5 is a block diagram illustrating an example of the timing controller of FIG. 4 that deactivates at least one clock signal generator selected among the plurality of clock signal generators.

Referring to FIGS. 4 and 5, the timing controller 440 includes a display mode detection unit 442, a plurality of clock signal generators 445-1, 445-2 and 445-3, and a plurality of signal converting units 447-1, 447-2 and 447-3. In an exemplary embodiment, the timing controller 440 further includes an image processor 449. In an exemplary embodiment, each of the clock signal generators 445-1, 445-2 and 445-3 includes a phase locked loop, and each of the signal converting units 447-1, 447-2 and 447-3 includes a plurality of gigabit transceivers.

The display mode detection unit 442 detects an image display mode of a display panel based on a plurality of first image data signals DATA1-1, DATA1-2 and DATA1-3. As illustrated in FIG. 5, the display mode detection unit 442 may activate a first clock signal generator 445-1 and a third clock signal generator 445-3 according to an image display mode. For example, the display mode detection unit 442 may generate a first activation signal E1 and a third activation signal E3, apply the first activation signal E1 to the first clock signal generator 445-1, and apply the third activation signal E3 to the third clock signal generator 445-3. The display mode detection unit 442 may deactivate a second clock signal generator 445-2.

The first clock signal generator 445-1 and the third clock signal generator 445-3 may generate the second clock signal CLK having the second frequency, and apply the second signal CLK to a first signal converting unit 447-1 and a third signal converting unit 447-3, respectively. As a result, the first signal converting unit 447-1 converts the first image data signal DATA1-1 into a second image data signal DATA2-1, and the third signal converting unit 447-3 converts the first image data signal DATA1-3 into a second image data signal DATA2-3.

In contrast, the second clock signal generator 445-2 does not generate the second clock signal CLK. Thus, the second signal converting unit 447-2 in which the second clock signal is not applied does not convert the first image data signal DATA1-2 into the second image data signal DATA2-2. As a result, power consumption of the second signal converting unit 447-2 may be reduced.

As described above, the timing controller 440 selectively activates the clock signal generators 445-1, 445-2 and 445-3 based on the display image mode so that power consumption in an image data processing may decrease. Thus, heat from the timing controller 440 may decrease. As a result, the display device may prevent heat damage caused by operating the timing controller 440.

Figure 6:
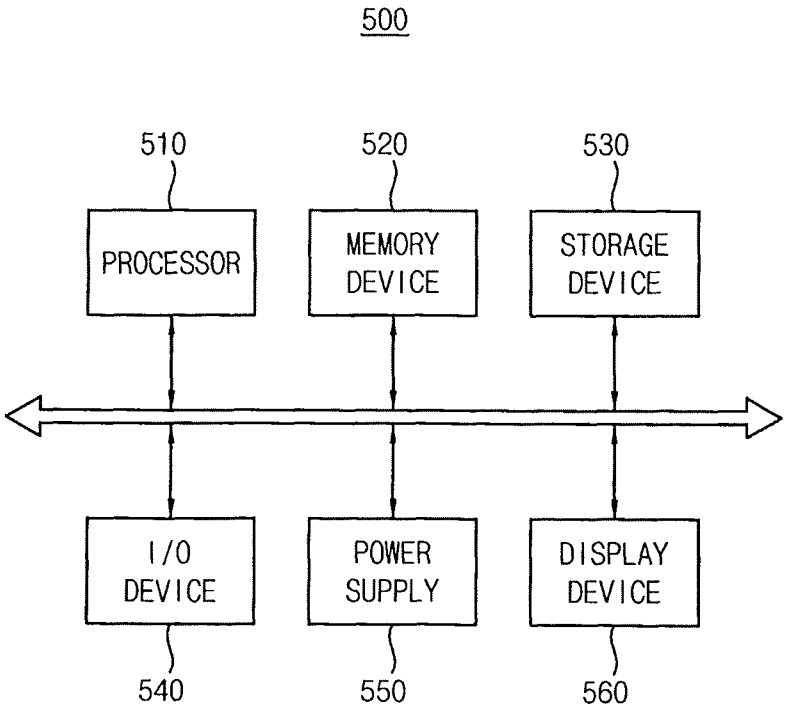
FIG. 6 is a block diagram of an electronic system having a display device of FIG. 1.

FIG. 6 is a block diagram of an electronic system having a display device of FIG. 1.

Referring to FIG. 6, the electronic system 500 includes a processor 510, a memory device 520, a storage device 530, an input/output (I/O) device 540, a power supply 550, and a display device 560. The electronic system 500 may further include a plurality of ports for communicating with a video card, a sound card, a memory card, a universal serial bus (USB) device, and/or other electronic systems. The display device 560 may correspond to the display device 100 of FIG. 1.

The processor 510 may perform various computing functions or tasks. The processor 510 may be, for example, a microprocessor, a central processing unit (CPU), or other processing device or controller. The processor 510 may be connected to other components via an address bus, a control bus, a data bus, etc. Further, the processor 510 may be coupled to an extended bus such as a peripheral component interconnection (PCI) bus.

The memory device 520 may store data for operations of the electronic system 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 530 may be, for example, a solid state drive (SSD) device, a hard disk drive (HDD) device, a CD-ROM device, etc. The I/O device 540 may be, for example, an input device such as a keyboard, a keypad, a mouse, a touch screen, etc., and/or an output device such as a printer, a speaker, etc. The power supply 550 may supply power for operations of the electronic system 500. The display device 560 may communicate with other components via the buses or other communication links.

The display device 560 may include a display panel 120, a display panel driver 140, a plurality of frame rate controllers 160-1, 160-2 and 160-3, and a timing controller 180. The timing controller 180 may include a display mode detection unit, a plurality of clock signal generators, and a plurality of signal converting units.

The display mode detection unit detects an image display mode of the display panel and selectively activates at least one clock signal generator selected from among the clock signal generators based on the image display mode. In an exemplary embodiment, activated clock signal generators generate a second signal and deactivated clock signal generators do not generate the second clock signal. The signal converting units convert first image data signals into a plurality of second image data signals that are output in synchronization with the second clock signal. Power consumption of the signal converting units to which the second clock signal is not applied, may decrease.

As described above, the timing controller included in the display device 560 selectively activates the clock signal generators based on the display image mode so that power consumption in an image data processing may decrease. Thus, heat from the timing controller may decrease. As a result, the electronic system having the display device 560 may prevent heat damage caused by operation of the timing controller.

The present embodiments may be applied to any display device and any system including the display device. For example, the present embodiments may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of exemplary embodiments of the inventive concept, and is not to be construed as limiting thereof. Although a few exemplary embodiments have been described, those skilled in the art will readily appreciate that many modifications are possible in the exemplary embodiments without materially departing from the inventive concept. Accordingly, all such modifications are intended to be included within the scope of the inventive concept.

What is claimed is:

1. A timing controller, comprising:

a display mode detection circuit configured to detect an image display mode of a display panel based on a plurality of first image data signals that are output in synchronization with a first clock signal having a first frequency, and to selectively activate at least one clock signal generator selected from among a plurality of clock signal generators based on the detected image display mode;

the clock signal generators, wherein each clock signal generator, when activated by the display mode detection circuit, is configured to generate a second clock signal having a second frequency and to apply the second clock signal to a distinct one of a plurality of signal converting circuits, respectively; and the signal converting circuits are configured to convert the first image data signals into a plurality of second image data signals that are output in synchronization with the second clock signal, wherein each of the signal converting circuits comprises a plurality of gigabit transceivers, and wherein the first image data signals are transferred through a plurality of channels, and a whole number of the gigabit transceivers is the same as a whole number of the channels.

2. The timing controller of claim 1, wherein the display mode detection circuit is configured to deactivate at least one of the clock signal generators based on the detected display mode to reduce power consumption of the signal converting circuits.

3. The timing controller of claim 1, wherein each of the clock signal generators includes a phase locked loop (PLL).

4. The timing controller of claim 1, wherein the image display mode includes a multi-view mode in which the display panel alternately displays a plurality of contents, and wherein a number of the contents that are displayed on the display panel is the same as a number of the activated clock signal generators.

5. The timing controller of claim 1, wherein the first frequency is N times the second frequency, where N is an integer greater than or equal to 1.

6. The timing controller of claim 5, wherein a number of bits of the second image data signals transferred per clock cycle is N times a number of bits of the first image data signals transferred per clock cycle.

7. The timing controller of claim 1, further comprising: an image processor configured to perform an image processing on the second image data signals.

8. A timing controller, comprising:

a plurality of clock signal generator;

a plurality of signal converting circuits corresponding to the clock signal generator; and a display mode detection circuit configured to detect whether an image display mode of a display panel is a two-dimensional (2D) mode or 3D mode based on a plurality of first image data signals that are output in synchronization with a first clock signal having a first frequency, and to activate all of the clock signal generators when the detected image display mode is the 3D mode and deactivate at least one of the clock signal generators when the detected image display mode is the 2D mode, wherein each clock signal generator, when activated by the display mode detection circuit, is configured to generate a second clock signal having a second frequency and to apply the second clock signal to a distinct one of the plurality of signal converting, circuits, respectively, and wherein, the signal converting circuits are configured to convert the first image data signals into a plurality of second image data signals that are output in synchronization with the second clock signal.

9. The timing controller of claim 8 , wherein each of the clock signal generators includes a phase locked loop (PLL).

10. The timing controller of claim 8, wherein each of the signal converting circuits comprises a plurality of gigabit transceivers.

11. The timing controller of claim 10, wherein the first image data signals are transferred through a plurality of channels, and a whole number of the gigabit transceivers is the same as a whole number of the channels.

12. The timing controller of claim 1, wherein the image display mode includes a multi-view mode in which the display panel alternately displays a plurality of contents, and wherein a number of the contents that are displayed on the display panel is the same as a number of the activated clock signal generators.

13. The timing controller of claim 1, wherein the first frequency is N times the second frequency, where N is an integer greater than or equal to 1.

14. The timing controller of claim 13, wherein a number of bits of the second image data signals transferred per clock cycle is N times a number of bits of the first image data signals transferred per clock cycle.

15. The timing controller of claim 1, further comprising: an image processor configured to perform an image processing on the second image data signals.

16. A timing controller, comprising:

a plurality of clock signal generators;

a plurality of signal converting circuits corresponding to the clock signal generators; and a display mode detection circuit configured to detect whether an image display mode of a display panel is a single view mode or a multiple view mode based on a plurality of first image data signals that are output in synchronization with a first clock signal having a first frequency, and to activate all of the clock signal generators when the detected image display mode is the multiple view mode and deactivate at least one of the clock signal generators when the detected image display mode is the single view mode, wherein each clock signal generator, when activated by the display mode detection circuit, is configured to generate a second clock signal having a second frequency and to apply the second clock signal to a distinct one of the plurality of signal converting circuits, respectively, and, wherein the signal converting circuits are configured to convert the first image data signals into a plurality of second image data signals that are output in synchronization with the second clock signal.

17. The timing controller of claim 16, wherein each of the clock signal generators includes a. phase locked loop (PLL).

18. The timing controller of claim 16, wherein the first frequency is N times the second frequency, where N is an integer greater than or equal to 1.

19. The timing controller of claim 18, wherein a number of bits of the second image data signals transferred per clock cycle is N times a number of bits of the first image data signals transferred per clock cycle.

20. The timing controller of claim 16, further comprising: an image processor configured to perform an image processing on the second image data signals.

* * * * *